US008794270B2

(12) United States Patent
Lama

(10) Patent No.: US 8,794,270 B2
(45) Date of Patent: Aug. 5, 2014

(54) METHOD FOR WEAVING AN ANTIQUED RAG TIBETAN WEAVE CARPET

(75) Inventor: Nurbu Lama, Kathmandu (NP)

(73) Assignee: Phoenix Weave, LLC, Baltimore, MD (US)

( * ) Notice: Subject to any disclaimer, the term of this patent is extended or adjusted under 35 U.S.C. 154(b) by 338 days.

(21) Appl. No.: 13/110,535

(22) Filed: May 18, 2011

(65) Prior Publication Data

US 2012/0291908 A1 Nov. 22, 2012

(51) Int. Cl.

| | |
|---|---|
| ***D03D 23/00*** | (2006.01) |
| ***D03D 43/00*** | (2006.01) |
| ***D03D 15/00*** | (2006.01) |
| ***D03D 27/06*** | (2006.01) |

(52) U.S. Cl.

USPC ..... 139/37; 139/2; 139/3; 139/4; 139/7 F; 139/38; 139/43; 139/302; 139/291 C; 139/391; 139/392; 8/137; 8/115.51; 8/115.6; 8/116.1; 57/3; 57/314; 57/327; 57/362

(58) Field of Classification Search

USPC ..... 8/137, 918, 929, 115.51, 115.6, 116.1; 139/116.1, 116.5, 392, 400, 2, 3, 4, 7 F, 139/37, 38, 302, 291 C, 391; 37/3, 314, 327, 37/362

See application file for complete search history.

(56) References Cited

U.S. PATENT DOCUMENTS

| | | | | |
|---|---|---|---|---|
| 4,152,886 | A * | 5/1979 | Nelson | 57/208 |
| 2010/0184855 | A1 * | 7/2010 | Bernhardt et al. | 514/529 |

OTHER PUBLICATIONS

Smeda Document, Hand Made Carpet Manufacturing, Nov. 2007.*
Namaste Rug Document, 2006.*
Customer Awareness inTrends for Silk and Carpet Processign, Aug. 22, 2008.*

* cited by examiner

*Primary Examiner* — Lorna M Douyon
*Assistant Examiner* — Amina Khan
(74) *Attorney, Agent, or Firm* — K&L Gates LLP

(57) ABSTRACT

A method for weaving a carpet including tying a row of knots with a yarn and weaving two or more weft strands next to the row of knots, where the weft strands are 100% cotton and the yarn is wool yarn hand-carded and hand-spun into a single strand is described.

4 Claims, 5 Drawing Sheets

METHOD FOR WEAVING AN ANTIQUED RAG TIBETAN WEAVE CARPET

FIELD OF INVENTION

The present invention relates generally to the field of weaving. In particular, the invention relates to the field of weaving antiqued rag Tibetan weave carpets.

BACKGROUND

Typically, a Tibetan carpet or rug may be woven with a single warp thread and a single weft thread per knot. The yarn used to make the knots may include three-plies of yarn spun into a single-strand. The standard Tibetan knot may be constructed by looping yarn around two warp threads, then around a temporary rod placed in front of the warp threads.

SUMMARY

In accordance with one embodiment, a method for weaving a carpet includes tying a row of knots with yarn and weaving two or more weft strands next to the row of knots, where the weft strands are 100% cotton and the yarn is wool yarn hand-carded and hand-spun into a single strand.

Additional objects, advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE FIGURES

The features and advantages of embodiments of the present invention can be understood by reference to the following detailed description taken with the following figures of embodiments of the invention.

DETAILED DESCRIPTION

For the purposes of promoting an understanding of the principles of the invention, reference will now be made to certain preferred embodiments thereof and specific language will be used to describe the same. It will nevertheless be understood that no limitation of the scope of the invention is thereby intended, such alterations, further modifications, and applications for the principles of the invention as described herein being contemplated as would normally occur to one skilled in the art to which the invention relates.

Figure 1:
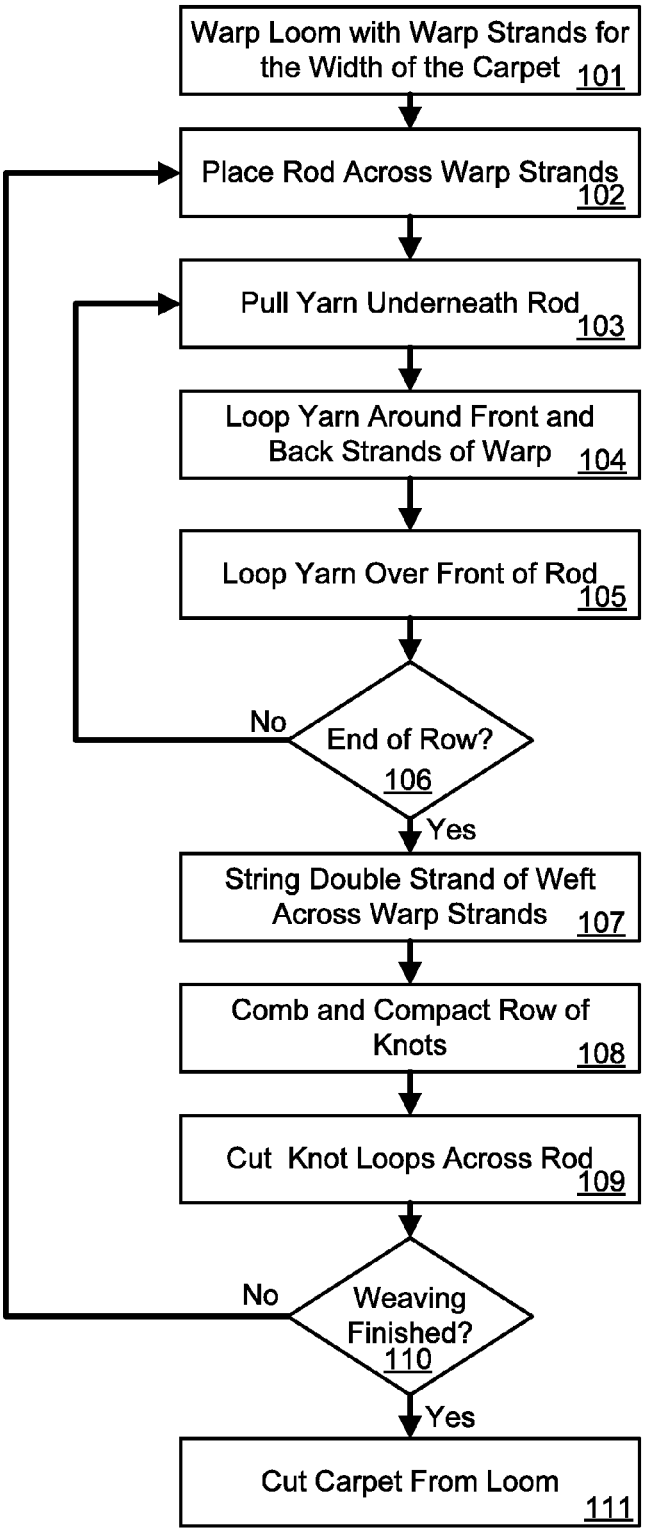
FIG. 1 depicts an exemplary procedure for weaving an antiqued rag Tibetan weave carpet.

FIG. 1 depicts an exemplary procedure for weaving an antiqued rag Tibetan weave carpet. FIGS. 2*a-g* depict exemplary steps for weaving an antiqued rag Tibetan weave carpet. The carpet may be any manner of Tibetan weave carpet or rug.

Figure 2B:
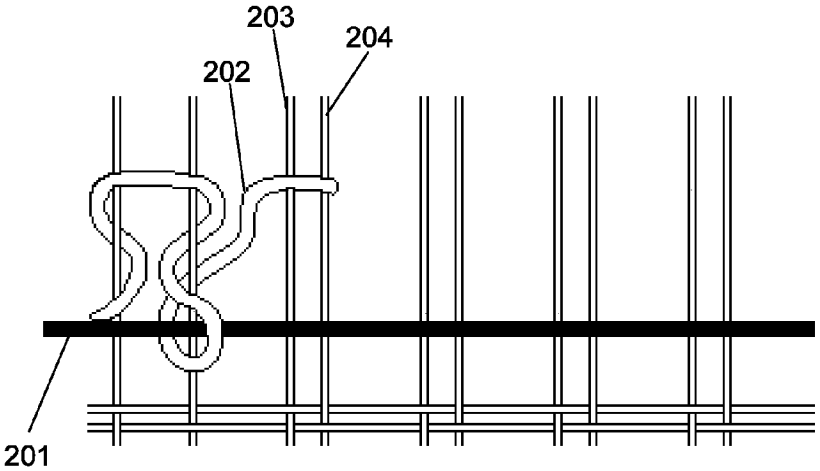
FIGS. 2*a-g* depict exemplary steps for weaving an antiqued rag Tibetan weave carpet.
Figure 2D:
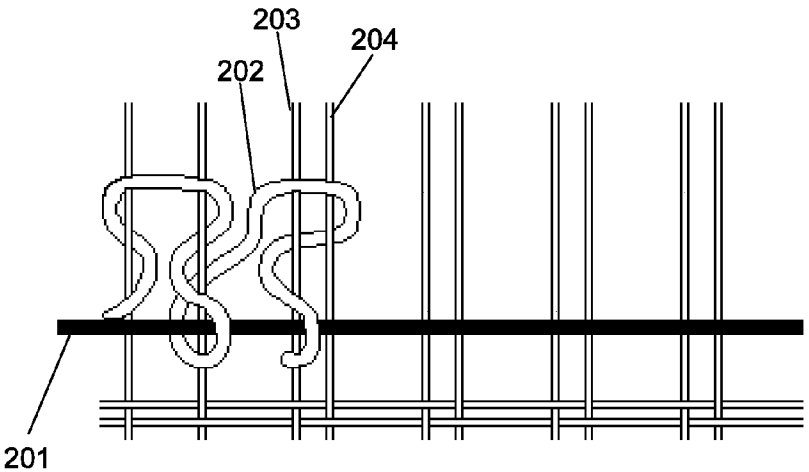
Figure 2A:
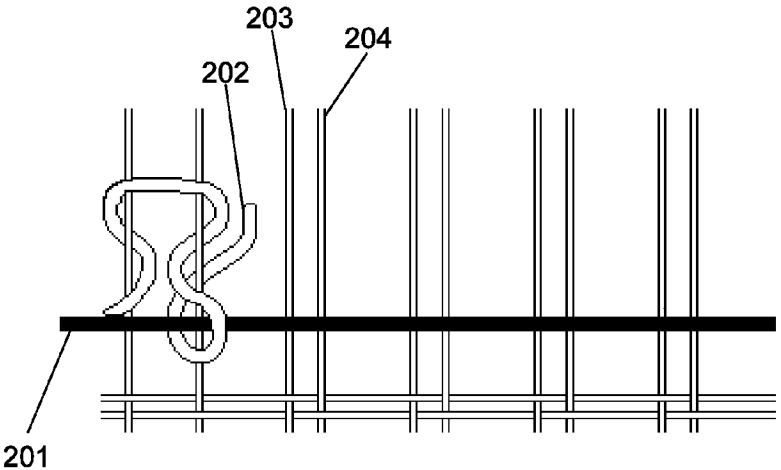

In block 101 a loom may be warped with warp strands for the width of the carpet. The individual warp strands may be strung from the top to the bottom of the loom, creating front and back strands, such as the warp strands 203 and 204 as depicted in FIG. 2*a*, and the number of the warp strands used across the width of the loom may depend on the size of the loom and the intended size and quality of the carpet. The loom may be any suitable loom used for weaving. The warp strands may be made of any suitable material, such as, for example, 100% cotton.

In block 102, a rod may be placed in front of the warp strands. For example, as depicted in FIG. 2*a*, the rod 201 may be placed in front of and perpendicular to the warp strands, including the warp strands 203 and 204. The rod 201 may be made of any suitable material, including, for example, metal, and may be any suitable length, including as long or longer than the intended width of the carpet. For example, the rod 201 may be an aluminum rod with a 3 mm diameter.

In block 103, yarn may be pulled underneath the rod 201. For example, as depicted in FIG. 2*a*, the yarn 202 may be pulled underneath the rod 201, to make the beginning of a knot. If the knot is the first knot in a row, after the placement of the rod 201, the yarn 202 may instead be pulled under the first warp strand on the loom. The yarn 202 may be any suitable material, including wool yarn manufactured through a process of hand-carding and hand spinning into a single strand approximately 3/16" in diameter. The yarn 202 may be dyed by hand in dye-pots using Swiss Optilan-dyes twice, which may give the yarn 202 an uneven appearance similar to that of a natural vegetable dye process. The yarn 202 may be single-ply, and the thickness of the single ply yarn 202 may cause the dye to take less in the center of the yarn 202, causing additional variance in the tone of the color of the yarn 202 when the yarn 202 is cut.

Figure 2C:
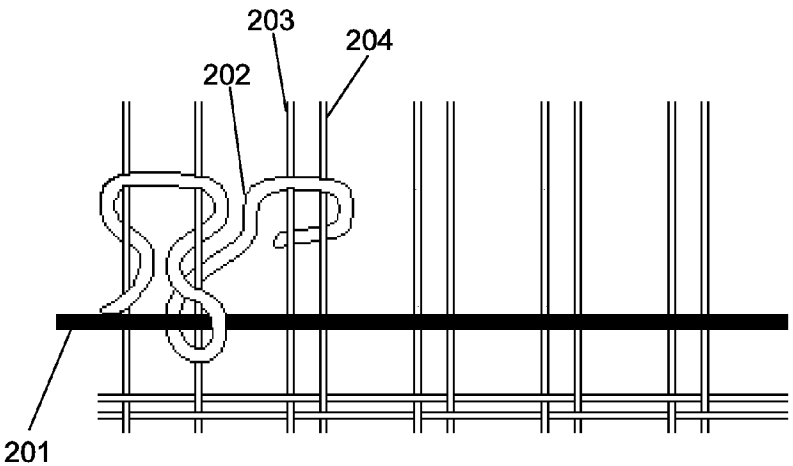

In block 104, the yarn 202 may be looped around front and back warp strands. For example, as depicted in FIG. 2*b*, the yarn may be pulled from under the rod 201 over the warp strands 203 and 204. As depicted in FIG. 2*c*, the yarn 202 may then be looped around the warp strands 203 and 204.

In block 105, the yarn 202 may be looped over the front of the rod 201. For example, as depicted in FIG. 2*d*, the yarn 202 may be pulled to the front of the loom, in front of the warp strand 203 and the rod 201. If the knot is at the end of the row, this may complete the knot.

Figure 2F:
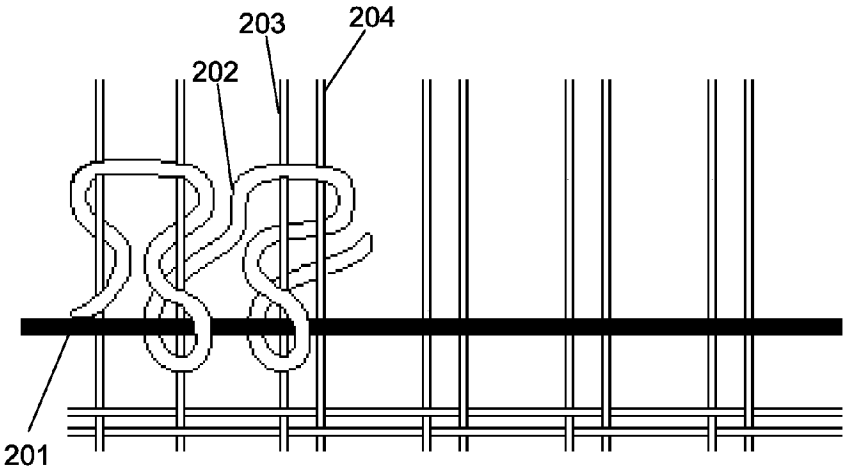
Figure 2E:
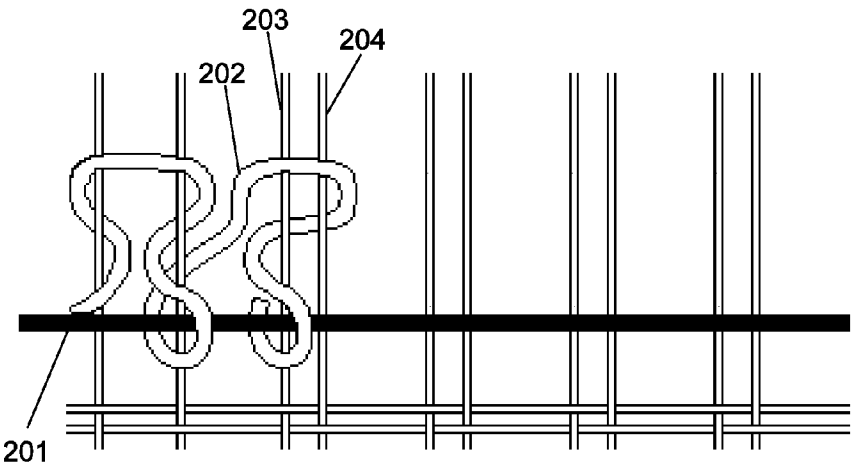

In block 106, if the end of the row has been reached, flow may proceed to block 107, otherwise flow may proceed back to block 103. When a knot has been tied on all of the front and back warp strands across the width of the loom, the end of the row may be reached. Otherwise, if there are remaining front and back warp strands in the row, the weaving of knots on the row may continue from the just completed knot, starting again in block 103. As depicted in FIG. 2*e*, the yarn 202 may then be pulled under the rod 201, looping the yarn 202 around the rod 201. This may complete the knot. As depicted in FIG. 2*f*, the yarn 202 may be pulled under the warp strands 203 and 204, allowing the next knot to be started as the previous knot was started in FIG. 2*a*.

In order to create patterns in the carpet, different yarns 202 may be used in the same row of knots, allowing for different colored knots in the same row. Any suitable technique may be used to switch between the yarns 202 in a single row of knots.

Figure 2G:
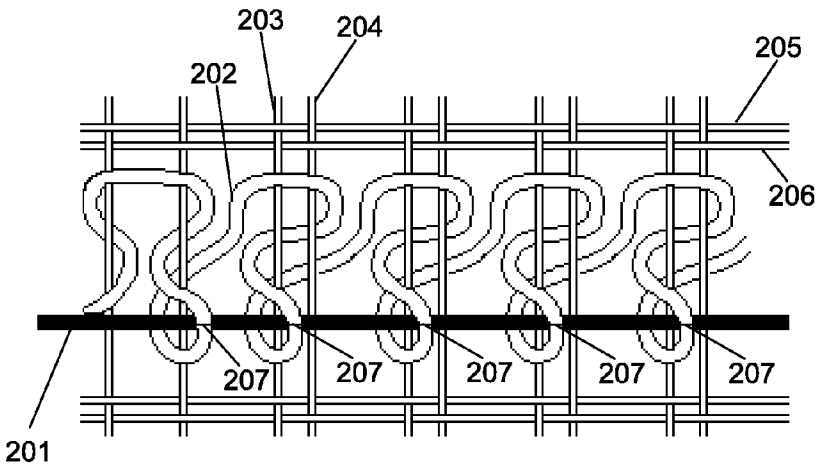

In block 107, when the end of the row has been reached, a double strand of weft may be strung across the warp strands. For example, as depicted in FIG. 2*g*, once knots have been tied across the warp strands for the width of the loom, the weft strands 205 and 206 may be woven into the warp strands. The weft strands 205 and 206 may be made of any suitable material, such as, for example, 100% cotton. The weft strands 205 and 206 may be interwoven with the warp strands, for example, in an alternating "over-under" manner. The weft strands 205 and 206 may be strung perpendicular to the warp strands and next to the completed row of knots. The use of more than one weft strand per row of knots may reduce the amount of wool used in the carpet, and may also give the carpet a more relaxed hand.

In block 108, the row of knots may be combed and compacted. For example, a wooden hammer may be used to compact the row of knots.

In block 109, the knots may have their loops cut across the rod 201. In blocks 105 and 103, the yarn 202 may have been looped around the rod 201. Each knot may have a loop. A cutting device, such as, for example, a razor blade, may be used to cut open the loops, for example by running the razor blade along the length of the rod 201 through the loops. As depicted in FIG. 2*g*, the loops may be cut along line 207, where the loops cross in front of the rod 201. This may result in a row of finished and cut knots.

Figure 3:
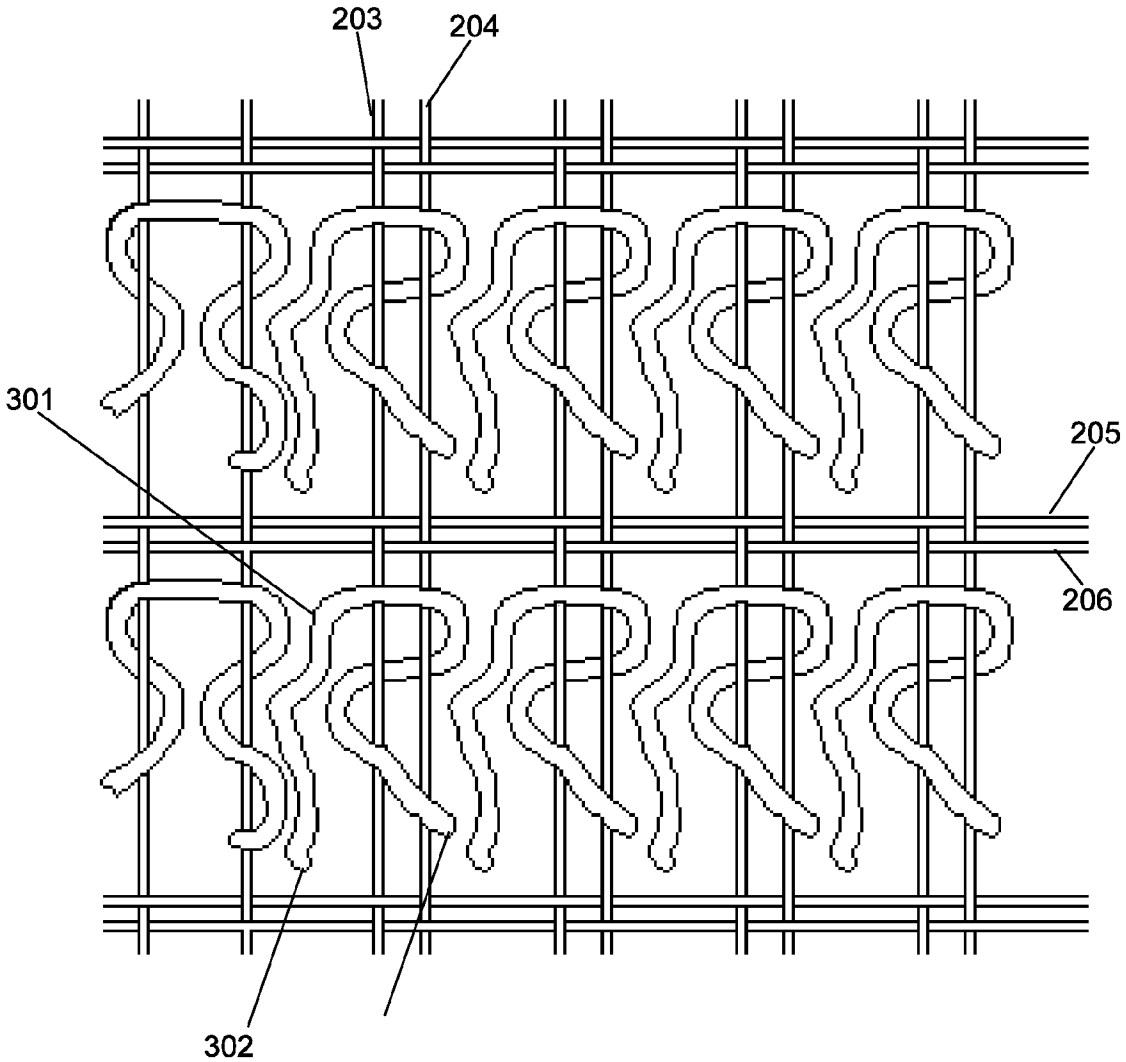
FIG. 3 depicts exemplary rows of finished and cut knots in an antiqued rag Tibetan weave carpet.

FIG. 3 depicts exemplary rows of finished and cut knots in an antiqued rag Tibetan weave carpet. When the loops are cut along the rod 201, the yarn 202 in a row of knots may become discontinuous. The finished and cut knot 301 may have two ends 302 and 303. The ends 302 and 303 may form part of the pile of the carpet, and the collection of the ends of all of the finished and cut knots in a carpet may be the pile of the carpet.

In block 110, if the weaving of the carpet is finished, flow may proceed to block 111. Otherwise flow may proceed back to block 102. If all of the rows in the carpet have been completed, the weaving of the carpet may be finished. Otherwise, if there are still rows left to be completed, for example, knots have not been tied on the entire length of all of the warp strands on the loom, the weaving may continue with the placing of the rod 201 in front of the warp strands to start a new row, as in block 102.

In block 111, the carpet may be cut out of the loom. When the weaving of the carpet is complete, the carpet may be removed from the loom using any suitable method, including, for example, cutting the carpet out of the loom.

Figure 4:
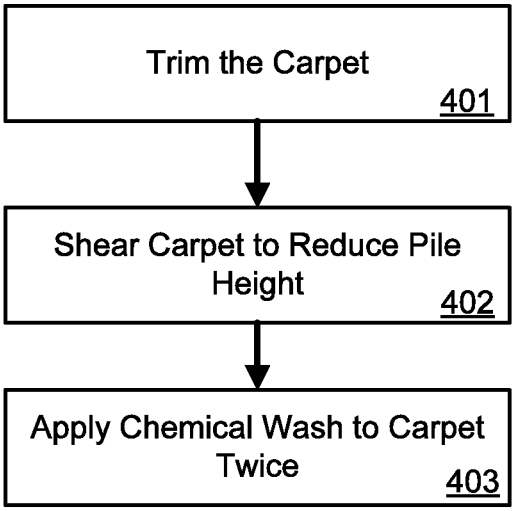
FIG. 4 depicts an exemplary procedure for finishing an antiqued rag Tibetan weave carpet.

FIG. 4 depicts an exemplary procedure for finishing an antiqued rag Tibetan weave carpet. After the weaving of the carpet is complete and the carpet has been cut from the loom, the carpet may be finished. In block 401, the carpet may be trimmed. For example, the warp threads may need to be trimmed after the carpet is cut from the loom.

In block 402, the carpet may be sheared to reduce the height of the pile. Any suitable shearing equipment may be used to shear the carpet to the desired pile height. For example, the pile may be sheared to a height of approximately ⅜".

In block 403, a chemical wash may be applied to the carpet twice. The chemical wash may include, for example, Sulfuric Acid, Acetic Acid, Caustic, Bleaching Powder and Paste. Applying the chemical wash to the carpet twice may result in increased luster and shine, and may impart an aged feel to the carpet.

The use of the weaving process, as described in FIG. 1, and the finishing process, as described in FIG. 4, may be referred to as the Phoenix Weave technique. Carpets produced with the Phoenix Weave technique may be Phoenix Weave carpets.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein. It should be appreciated that the figures are presented for illustrative purposes and not as construction drawings. Omitted details and modifications or alternative embodiments are within the purview of persons of ordinary skill in the art.

It can be appreciated that, in certain aspects of the present invention, a single component may be replaced by multiple components, and multiple components may be replaced by a single component, to provide an element or structure or to perform a given function or functions. Except where such substitution would not be operative to practice certain embodiments of the present invention, such substitution is considered within the scope of the present invention.

The examples presented herein are intended to illustrate potential and specific implementations of the present invention. It can be appreciated that the examples are intended primarily for purposes of illustration of the invention for those skilled in the art. The diagrams depicted herein are provided by way of example. There may be variations to these diagrams or the operations described herein without departing from the spirit of the invention. For instance, in certain cases, method steps or operations may be performed or executed in differing order, or operations may be added, deleted or modified.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A method for weaving a carpet consisting of:

for each row within a loom:

(i) tying a row of knots with a yarn that is hand-carded and hand spun into a single ply, each knot looping around at least two warp strands;

(ii) weaving two or more cotton weft strands next to the row of knots;

(iii) compacting the row with an adjacent row within the loom; and cutting a loop of each knot;

cutting the carpet from the loom;

trimming the warp threads;

shearing the carpet;

applying a chemical wash to the carpet wherein the chemical wash is a combination of sulfuric acid, acetic acid and caustic; and reapplying said chemical wash to the carpet.

2. The method of claim 1, wherein the yarn is 3/16" in diameter.

3. The method of claim 1, wherein the chemical washes increase the luster and shine of the carpet.

4. The method of claim 1, wherein the knots are Tibetan knots.

* * * * *